United States Patent [19]

Büchl

[11] Patent Number: 5,076,231

[45] Date of Patent: Dec. 31, 1991

[54] METHOD AND APPARATUS FOR MECHANICAL OVERRIDE CONTROL OF ELECTRONIC THROTTLE VALVE OPERATION DURING EMERGENCIES

[75] Inventor: Josef Büchl, Lenting, Fed. Rep. of Germany

[73] Assignee: Audi AG, Ingolstadt, Fed. Rep. of Germany

[21] Appl. No.: 565,281

[22] Filed: Aug. 9, 1990

[30] Foreign Application Priority Data

Aug. 10, 1989 [DE] Fed. Rep. of Germany ..... 3926424

[51] Int. Cl.[5] ..... F02D 9/02; F02D 9/08

[52] U.S. Cl. ..... 123/399; 123/361

[58] Field of Search ..... 123/360, 361, 397, 398, 123/399

[56] References Cited

U.S. PATENT DOCUMENTS

| | | | |
|---|---|---|---|
| 4,453,516 | 6/1984 | Filsinger | 123/399 |
| 4,470,396 | 9/1984 | Hasumi et al. | 123/478 |
| 4,671,235 | 6/1987 | Hosaka | 123/399 |
| 4,718,380 | 1/1988 | Katayose et al. | 123/399 |
| 4,785,782 | 11/1988 | Tanaka et al. | 123/399 |
| 4,860,708 | 8/1989 | Yamaguchi et al. | 123/399 |
| 4,879,657 | 11/1989 | Tamura et al. | 123/399 |
| 5,018,496 | 5/1991 | Buchl | 123/361 |

*Primary Examiner*—E. Rollins Cross
*Assistant Examiner*—Robert E. Mates
*Attorney, Agent, or Firm*—Jacques M. Dulin; Thomas C. Feix

[57] ABSTRACT

Mechanical emergency override assembly for an electronic throttle valve assembly of the type having a servomotor to control the closure of the throttle valve flap in the range of from 0° to about 4°-15° in accord with predetermined criteria. The mechanical emergency override improvement comprises dual stop assemblies, which in emergency operation are counteractive when disabled to provide a mechanical stop at about a 5° opening and permit a snap linkage between the setting unit and throttle flap arm to be engaged for mechanical (gas pedal) operation throughout the full range of opening. The servo is spring linked to a second throttle flap arm and can disengage this mechanical override. Normal throttle wider opening, and emergency operation at angles from 5° to full open, are controlled by the driver actuating the gas pedal, but the actual valve flap opening angle is microprocessor-controlled via the servo to be less than the pedal angle on a predetermined curve. A setting control unit is provided to permit a full range of idle control adjustments. The setting control unit also includes a first stop assembly for idle control and for cruise control setting. Desired value and actual throttle opening value transducer transmitters provide signals to a microprocessor which integrates the information into control of the servo and the stop assemblies. The microprocessor can also control the throttle based on additional inputs from engine operating conditions, load conditions, wheel spin, angle slip, and the like, to provide optimum engine operation and fuel economy, and permits operation of the mechanical override in an emergency.

16 Claims, 2 Drawing Sheets

METHOD AND APPARATUS FOR MECHANICAL OVERRIDE CONTROL OF ELECTRONIC THROTTLE VALVE OPERATION DURING EMERGENCIES

CROSS REFERENCE TO RELATED CASE

This application describes an improvement over my copending U.S. application Ser. No. 498,341 filed Mar. 23, 1990, now U.S. Pat. No. 5,018,496 issued May 28, 1991, for method and apparatus for throttle valve control in internal combustion engines, the disclosure of which is hereby incorporated by reference to the extent needed for general background of certain mechanical and electronic linkages, sensing and control.

FIELD

The invention relates generally to a method and apparatus for controlling the operation of a throttle valve for use in internal combustion engines. More particularly, the invention relates to a method and apparatus for mechanical override and control of electronic throttle valves of the type shown in my copending application Ser. No. 498,341, i.e., the type in which a servomotor, controllable in response to actual setting value and desired setting value transducers, limits the amount of throttle valve closure in response to a total release of pressure on the gas pedal.

BACKGROUND

An example of an internal combustion engine having a throttle valve of the general type has been described in DE-OS No. 37 11 779. The throttle valve described therein is controlled by a conventional mechanical throttle linkage and an electronic servomotor. Electronic control of the gas pedal is achieved by using the servomotor to control the throttle valve operation between the phases of the completely closed position, (0° setting) and the maximum open position specified by a mechanical transducer. When the gas pedal is not being depressed, the mechanical throttle linkage (transducer) will fully close the throttle valve. In the event of a failure of the servomotor, the throttle valve is still fully operable by the manual override capability of the mechanical throttle valve linkage. Thus, the safety of a mechanical gas pedal is achieved while using the potentials of control of an electronic gas pedal.

In my copending application Ser. No. 498,341, based on European Application EP-A 89105378.7, I disclose an improvement over the throttle valve of German Patent Disclosure 37 11 779, which allows integration of an idle fuel-injection controller, a cruise control system, and an antislip control.

It is desirable to keep the throttle valve open a slight degree (preferably between 0°-10°) during idle conditions to ensure that the engine remains ready to rev up.

Imprecise or inadequate control of the throttle valve usually results in a momentary stall during an acceleration from the idle condition. Thus, there is a definite need in the art to improve engine operating performance and fuel efficiency through more precise control of throttle valve operation. There is also a need to increase the reliability of electronic throttle valves in case of electronics failure and especially to allow safe emergency operation.

THE INVENTION

Objects

It is among the objects of the invention to provide methods and apparatus for the emergency operation of an electronic unit for a throttle valve of an internal combustion engine by providing a disconnectable mechanical override linkage system, and in which the electronically controlled servo keeps the opening angle of the throttle valve smaller than mechanically specified due to control of the servo opening angle in response to a sensed gas pedal setting pursuant to a predetermined relationship.

Still other objects of the invention will be evident from the specification and drawings.

DRAWINGS

The invention is illustrated in more detail by reference to the drawings in which:

FIG. 1 is an isometric view of the entire throttle valve control assembly showing the throttle valve in the near by closed position; and FIG. 2 is a graph of the relationship between the gas pedal setting and the opening angle of the throttle valve in degrees.

SUMMARY

An improved throttle valve assembly comprising three co-axially aligned but spaced sub-assemblies: the main throttle valve unit, a setting unit and a pivot unit. The main throttle valve has a rotatable closure flap which is actuatable by a servomotor for small closure angles (from 0° to about 4°-15°) for idle control and cruise control settings. The closure flap is also controllable by the driver for other ranges through a mechanical linkage from the gas pedal via the pivot unit and setting unit. The invention is directed primarily to improvements in an added stop adjuster assembly and in an emergency condition linkage of the setting unit to the throttle valve unit, wherein the maximum opening angle of the throttle valve is mechanically specified, while smaller angles are electronically set. Upon emergency, e.g., failure of the electronic system, the throttle valve flap assembly connects (e.g., via a snap-link) with the mechanical linkage; i.e., there is mechanical override so the throttle valve can continue to be operated mechanically via the gas pedal.

In accord with this invention, the maximum opening contact point of the throttle valve is mechanically specified, while the electronically-controlled servomotor keeps the actual opening angle of the throttle valve flap smaller than mechanically specified in an amount in accord with a predetermined relationship between the opening angle and the gas pedal setting in the operating range.

Only upon activation in emergency operation does a protrusion (such as a snap ball), located on a radial lever extension of the shaft bearing the throttle valve flap, come into contact with a contact point (such as a snap cup) disposed on a force tang associated with the closure stop pin assembly portion of the setting unit for the throttle valve flap. In accord with the invention, once contact is made and the parts are mechanically linked together, e.g. snapped-in, the throttle valve flap is then moved directly mechanically by the cable from the gas pedal, and the flap angle is no longer adjusted by the servomotor. The snap-link described above employs a spring, although any other snap-linkage known in the state of the art can be used, such as a ball and cup (socket) snap closure. Linkage via magnets is also possible.

In a preferred embodiment two stop adjuster assemblies (spring plates) are provided. The first assembly is described in my U.S. Ser. No. 98,341 filed 3/23/90 (EP-A 89105378.7). It limits the mechanical setting of the throttle valve flap to about 10°-11° open upon actuation (after pressure application), corresponding to a gasoline/air mixture throughput of about 60 kg/h. In the range between 0° and 11°, the throttle valve is controlled solely by the servomotor; in this manner idle fuel-injection control is possible.

In accord with the invention a second stop adjuster assembly in which the stop adjuster bolt extends in an emergency (via pressure application or removal). This second adjuster assembly is inactivated during normal operation, that is, it has no mission or defined stop point for the throttle valve flap. In case of emergency, the first stop assembly is deactivated (e.g., by release of pressure) and the stop bolt is retracted so that the throttle valve flap can close mechanically below (smaller than) the 10°-11° opening angle, while the second stop assembly is extended (due to application of or absence of pressure) to limit the closing angle of the throttle valve to an emergency gap of about 5°, corresponding to a mixture throughput of about 15 kg/h. Thus a minimum mechanical idle is maintained, and at the same time in this emergency setting, contact and snap-in of parts of the contact point between the lever and tang is assured for mechanical control by the gas pedal via the cable.

As disclosed in my copending Ser. No. 498,341 the setting unit includes a spring-biased lever with a tang that engages a lever on the throttle flap shift. The mechanical override snap link of this invention is located at the contact point between the tang and lever. The second stop adjuster assembly actuator bolt acts on a tang on the throttle flap lever. The setting unit spring has a spring force to bias the flap toward the closed position. The setting unit also includes a solenoid, pneumatic or hydraulic stop adjuster assembly with a set screw normally set to prevent mechanical linkage biasing of the throttle valve flap closed in ranges less than about 4°-15°. In the event of throttle valve unit servo failure the solenoid can move the stop to permit greater closure until the second stop adjuster is activated.

The pivot unit is also spring biased and has a lever with a tang engaging a lever on the shaft of the setting unit. As the gas pedal is depressed, a cable rotates the pivot unit, which in turn rotates the setting unit shaft permitting the throttle valve flap to open under its spring pressure.

The pivot unit has a potentiometer-type desired value transmitter (transducer) showing the rotational angle of the pivot unit shaft as a result of depressing the gas pedal. The throttle valve flap unit has an actual value transmitter (transducer) which shows the actual angle of rotation of the throttle valve to provide a reading of the actual opening (in degrees) of the throttle valve flap. These transducers provide input to a microprocessor which in turn controls the operation of the throttle valve servomotor, and one or more of two setting unit stop adjuster assemblies.

This invention permits control of the closure of the throttle valve for smoother and more efficient operation. The servo may be programmed for time delay or graduated slow closure from a setting of about 4°-15° to zero when the gas pedal is completely released in normal operation. Initially the flap closes to 4°-15° by the mechanical linkage of the three sub-assemblies, and is then closed smoothly and more slowly to zero by the servo. This prevents lurching when the gas pedal is abruptly released.

Likewise the idle setting is easily adjusted. The servo also provides smooth opening so there is no hesitation upon abrupt depressing of the gas pedal. The mechanical override and setting of a minimum 5°±2° stop point in case of failure of the throttle flap servo is a valuable safety feature of this invention.

DETAILED DESCRIPTION OF THE BEST MODE

The following detailed description illustrates the invention by way of example, not by way of limitation of the principles of the invention. This description will clearly enable one skilled in the art to make and use the invention, and describes several embodiments, adaptations, variations, alternatives and uses of the invention, including what I presently believe is the best mode of carrying out the invention.

Figure 1:
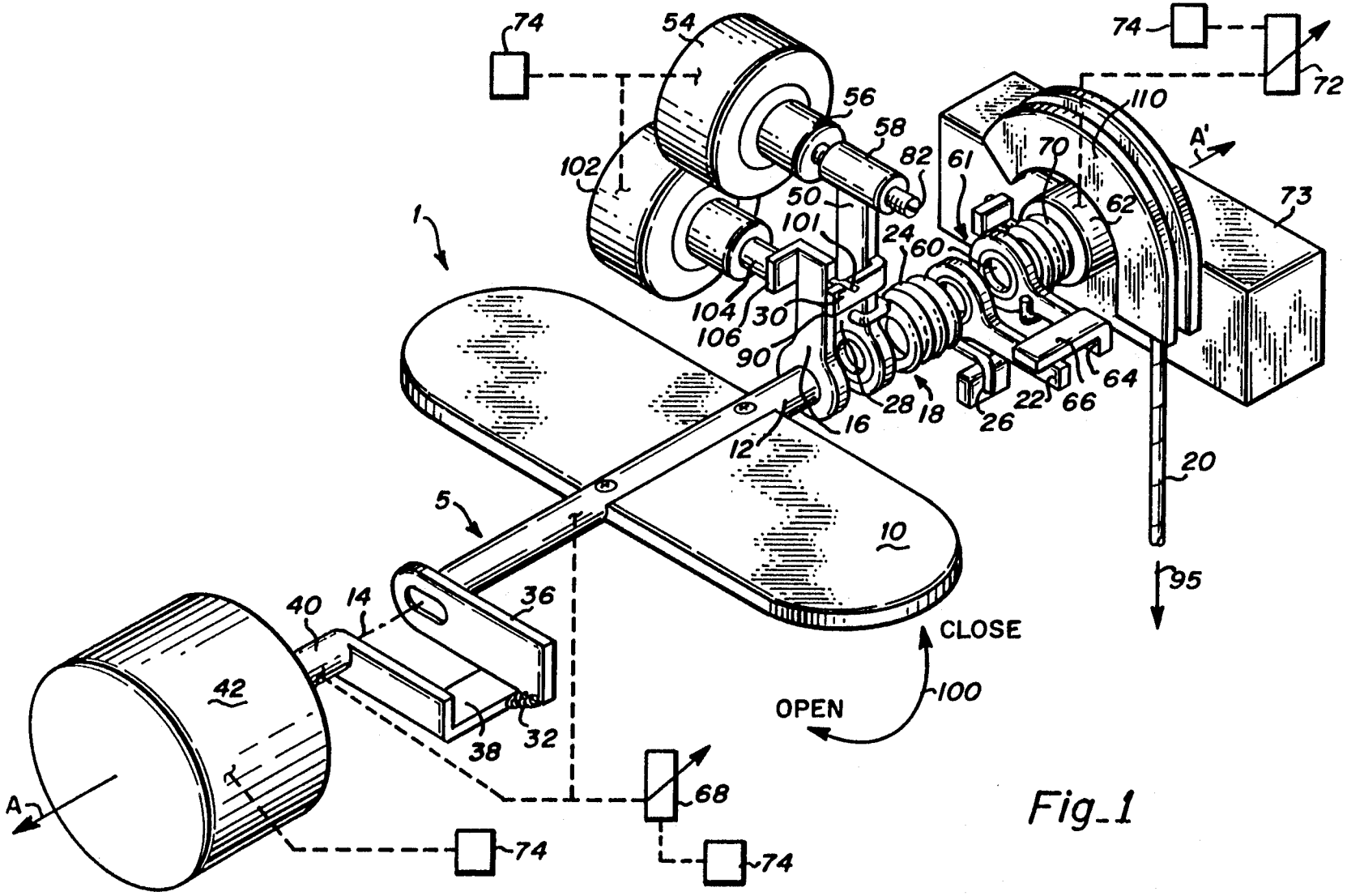

In FIG. 1 a throttle valve assembly 1, having a closure flap 10 is installed in an intake pipe (not shown) of an internal combustion engine; in the position illustrated here, the intake pipe is oriented horizontally with the throttle valve oriented in a perpendicular direction, i.e. up and down in FIG. 1. The throttle valve flap 10 is shown in an almost closed position; it can pivot about a shaft 12, and a pivot in the direction of Arrow 100 (clockwise) would bring the throttle valve flap 10 into its open position.

A throttle valve assembly constructed in accordance with the preferred embodiment of the present invention is indicated generally by the reference numeral 1 in the FIG. 1 For purposes of this description, all references to the "North" or "top" end of the throttle valve assembly will refer to the region on the right of FIG. 1 adjacent the pulley 110 and cable 20; see Arrow A'. Similarly, the "South" or "bottom" end of the throttle valve assembly will refer to the region on the left, adjacent the servomotor 42; see Arrow A. The A—A' axis is normally oriented vertically when installed in the intake tube of an internal combustion engine, end A down.

The throttle valve assembly 1 generally comprises three distinct units including: A throttle valve unit 5, a setting unit 18, and a pivot unit 61. All units are coaxially aligned along axis A—A'. They are described in pertinent detail separately below, and in more detail in my copending Ser. No. 498,341.

Shaft 12 terminates on its North end in a radial extension or lever 16 which is fixed to the throttle valve shaft 12. In that way it is force linked to the throttle valve assembly 5 so that it turns, or turns with, the flap 10. Coaxial with the axis 14 (also identified as axis A—A') of the throttle valve unit 5 is the shaft of setting unit 18. It has a drive lever 22 and an output lever 28. The rotation of the setting unit 18 is adjusted via the drive lever 22. The output lever 28 transfers this rotational motion in a manner described below, to the force-linked radial extension lever 16, which in turn initiates or follows the rotational motion of the throttle valve flap 10. A recoil (return) spring 24 is connected to either the drive lever 22, or as shown here, at the output lever 28. The other end of spring 24 is joined at point 26 to the engine. This recoil spring 24 is designed as a double spring (for safety reasons) and acts on the throttle valve flap 10 to urge it toward its closed position.

Output lever 28 has a tang 30 running parallel to, but spaced radially from, axis 14. This tang 30 is in contact with the valve flap lever 16. To regulate or control the throttle valve opening, a servomotor 42 is provided. This servomotor 42 is driven by an electronics system 74. It can be, for example, a slip control. The control electronics also includes data on the optimum fuel economy performance graphs, and thus keeps the opening angle of throttle valve flap 10 smaller that mechanically possible, as will be explained below with reference to FIG. 2.

If the throttle valve is forced in direction of its closed position, then electromotor 42 is triggered. It operates a shaft 40 that turns opposite the direction of Arrow 100 i.e., counterclockwise toward the closed position of Arrow 100. A tang-bearing arm 38 is in contact with a radial lever 36 on the South end of the throttle valve unit shaft 12. Rotation of the tang 38 against lever 36 turns the shaft 12 also in the direction of Arrow 100 closure. The radial lever 36 and tang 38 are linked together via a spring 32 that holds the lever 36 in contact with tang 38 in normal operation. But if throttle valve 10 is forced in its open direction mechanically against the contact setting between lever 36 and tang 38, then spring 32 can expand accordingly; this emergency operation will be explained below. It is essential that spring 32 have a smaller spring performance graph (weaker spring force) than the recoil spring 24.

An extension 50 of the output lever 28 of the setting unit 18 carries on its end 58 an adjustable stop screw 82 that in normal operation (with the gas pedal not operated) contacts an adjuster bolt 56 of a stop adjuster 54. This limits the rotation of setting unit 18 counterclockwise in the closing direction of throttle valve flap 10. The stop adjuster 54 can be an electromotor (servo), solenoid, or a pressure can (hydraulic or pneumatic reciprocating bidirectional piston); its bolt 56 extends outwardly (to the right in FIG. 1) during activation.

The setting lever 18 is turned in the direction of the open position of throttle valve flap 10, i.e. in the clockwise rotationally open direction of arrow 100, by a pivot unit 61 that can be rotated on shaft 60 by operation of a cable 20 that is linked to a gas pedal at the end of arrow 95 (not illustrated).

In FIG. 1, shaft 12 of throttle valve flap 10, the rotation axis of setting unit 18, and the rotation axis 60 of the pivot unit 61 are aligned coaxially with each other.

By means of a cable guide (pulley) 110 pivoting on shaft 60 in journal 62 in response to motion of cable 20 in the direction of arrow 95, a counter arm adjusting lever 64 can pivot about axis 60, which is coaxial with axis 14. Adjusting lever 64 has a tang 66 that presses the one side of drive lever 22 of setting unit 18 to rotate the setting unit clockwise in the direction of the flap open position. A recoil spring 70 is provided to ensure that when the gas pedal is not operated, and thus the cable 20 is slack, the pivot unit 61 is returned counterclockwise into its zero position.

Associated with the pivot unit 61 is a desired-value transducer (transmitter) 72 that outputs an electrical signal to microprocessor 74, which signal is representative of the load requirements generated, based on the driver's operation of the gas pedal.

An actual-value transducer 68 that determines the actual amount of closure of throttle valve flap 10, is connected either to shaft 12 or to shaft 40 as shown by the dashed lines. It outputs a value for the actual amount of opening of the throttle valve. The function of this control apparatus is described in detail in my copending Ser. No. 498,341 (EP-A 89105378.7) which is incorporated herein by reference. But a disadvantage of that arrangement is that when the servomotor is operating in an emergency it must work against a strong recoil spring 24 that maintains the contact between the lever 16 and tang 30.

To overcome this disadvantage, in the construction of this invention shown in FIG. 1, the lever 16 includes at its upper left edge a tang 106 that comes to rest against the extended setting pin or actuator bolt 104 of a second stop adjuster 102.

In normal operation, bolt 56 of the stop adjuster 54 is extended and bolt 104 of emergency override stop adjuster 102 is retracted, e.g. hydraulically against a spring bias. In emergency operation, upon deactivation of both stop adjusters 54 and 102, the bolt 56 of stop adjuster 54 retracts (e.g., is spring biased to retract), and bolt 104 of stop adjuster 102 extends.

At the opposite upper edge of lever 16 at contact point 90 is located a snap spring 101. It is essential to the invention that the contact between tang 30 and lever 16 causes those two parts to snap together (interlock). Then, when an emergency is detected, the first stop adjuster 54 spring-biased bolt 56 is deactivated, thus the output lever 28 could rotate counterclockwise i.e., closing to a position corresponding to throttle valve opening angle of 0°.

But complete closure to 0° is prevented by the second stop adjuster 102 which extends its spring-biased contact pin or bolt 104 in the deactivated state to form a stop for lever 16 that prevents closure of flap 10 to throttle valve angles < about 5°, so that idle operation is assured.

Under these conditions (emergency or servo failure), servomotor 42 returns to its opening position; it is not supplied with power, and can rotate clockwise, e.g. by internal or external recoil spring (not shown).

Now as soon as the throttle valve flap 10 is closed mechanically upon release of the gas pedal and a corresponding slack-off (upward) motion of cable 20 and counterclockwise effect of return spring 24, the lever 16 and tang 30 come into contact with each other at the contact point 90 and snap spring 101 wedges the two components together. Now the throttle valve flap is rotatable in the angular range between about a 5° throttle valve angle (generated by stop adjuster assembly 102) and a 90° throttle valve shaft angle (with gas pedal fully depressed) purely mechanically by the gas pedal vial the now rigid connection at contact point 90; the servomotor 42 is no longer active.

Figure 2:
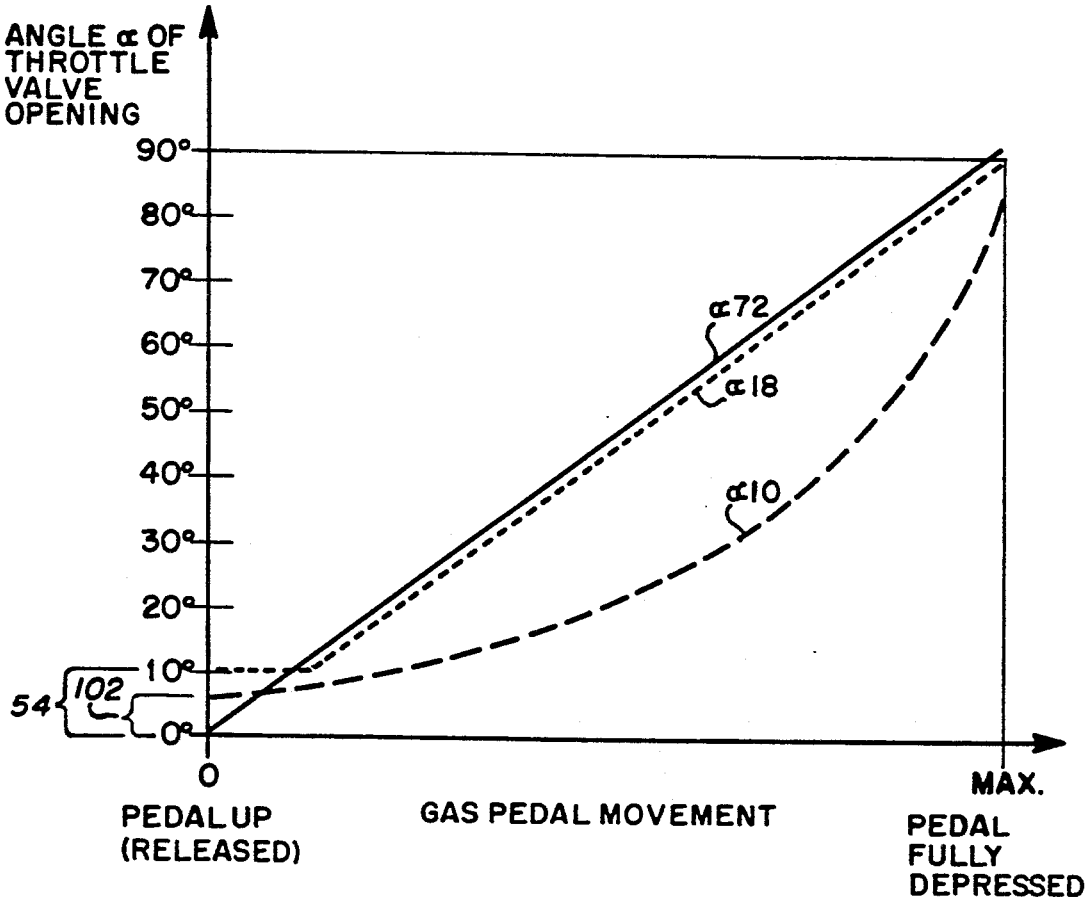

But it is important that in normal operation, the dependence of the throttle valve opening is adjusted by the gas pedal position so that there is not a linear relation to its performance graph, but rather, as shown in FIG. 2, the opening angle of the throttle valve flap 10 set via the servomotor 42, is smaller than is possible due to mechanical linkages. This behavior is desirable not only for efficient fuel consumption but also it is important in connection with the present invention. In normal operation the lever 16 cannot come into contact with tang 30 since the servomotor holds the throttle valve flap 10 closed so much that a distance always remains between lever 16 and tang 30. Only in emergency operation can these two parts come into contact with each other upon the retraction of stop bolt 56 and extension of bolt 104.

In FIG. 2 the movement of the gas pedal is plotted on the abscissa (X-axis); the ordinate (vertical, Y-axis) shows the attendant opening angle α. The curve designated at α 72 shows the relationship of the deflection angle of the cable disk pulley 110 in response to the gas pedal setting as sensed by the desired valve transducer 72. Curve α 18 shows the deflection angle of the intermediate setting unit output lever 28. Curve α 10 shows the maximum opening angle of the throttle valve flap in relation to the particular gas pedal setting as controlled by the apparatus of this invention, including microprocessor 74 controlling servo 42, and the action of the two stop adjusters 54 and 102. Servomotor 42 adjusts the throttle valve flap 10 between 0° and the angle indicated by the α 10 curve as a function of engine operating parameters. The particular data apply for normal operation, with extended stop adjuster (spring plate) 54 and retracted stop adjuster (spring plate) 102.

In the range of larger gas pedal motion (i.e., the gas pedal is depressed more), the output drive lever 28 leaves contact with bolt 56 and the rotational angle is created via the cable disk 110, which determines the sensed reading of the desired value potentiometer 72 and which coincides with the angle setting of the setting unit 18 as they are mechanically linked. In accordance with the specified performance graph (e.g., FIG. 2), the actual setting of the throttle valve flap 10 remains below (less than) this angular value.

In the region of small gas pedal motion, the output lever 28 comes into contact with bolt 56; the intermediate setting unit 18 retains a minimum deflection angle of about 11° as mentioned above. This is shown by the left end of the dotted α 18 line of FIG. 2, which is parallel to the abcissa at 11°. But the cable disk (pulley) 110 continues to rotate counterclockwise (closed); this desired setting is sensed by potentiometer 72. The actual opening angle α 10 of the throttle valve is controlled in the range below 11° by the electronic system 74.

It is important that curve α 18 always be above curve α 10 in the entire range; that is, tang 30 and lever 16 cannot come into contact. Only in emergency operation is the 11° open limitation lifted in the range of small gas pedal motion for the curve α 18, it can now fall off linearly to smaller values (not shown in FIG. 2, but parallel to the solid line in the region 11° down to the dashed line at 5°). But curve α 10 is seen in FIG. 2 to be limited to at least 5° by the extended bolt 104, thus lever 16 and tang can snap together. From this moment on, the throttle valve flap 10 is moved as a function of the gas pedal setting corresponding to curve α 72.

When the servomotor 42 presses against the radial arm 36 at the conclusion of emergency operation (just as in the starting procedure), then the snap link 101 is released, and the system switches back to its electronically controlled, normal mode.

With this invention it is possible to control the throttle valve flap 10 in a usual manner mechanically via a gas pedal to the desired deflection angle, even in case of failure of the electronic system and/or the servomotor 42.

Various sensors in the vehicle can be used to detect an emergency, including loss of electrical power or hydraulic pressure, inertia sensors, spin/slip sensors, crash detectors (e.g., air bag deployment), and the like. These sensors feed signals to microprocessor 74 which in turn can be preprogrammed to initiate the disablement of the dual stop assemblies to permit the mechanical override snap-link to engage.

It should be understood that various modifications within the scope of this invention can be made by one of ordinary skill in the art without departing from the spirit thereof. I therefore wish my invention to be defined by the scope of the appended claims as broadly as the prior art will permit, and in view of the specification if need be.

I claim:

1. Electronic throttle valve assembly for a gas pedal actuated internal combustion engine having a throttle flap open and a throttle flap closed position, comprising in operative combination:

a) a throttle valve unit having:
   i) first means for moving said throttle valve flap toward said throttle flap open position;
   ii) second means for engagement with a setting unit to move said throttle valve flap toward said throttle flap closed position; and
   iii) means for controlling the degree of opening and closing of the throttle valve between said closed position and said open position determined by a first stop adjuster means limiting the closing motion of a first stop means;

b) a setting unit having:
   i) first stop means for limiting the motion of the throttle valve flap toward said open position;

c) a first stop adjuster means for limiting the motion of the setting unit first stop means toward said throttle closed position and determining a first partially open position;

d) a second stop adjuster for limiting the motion of said throttle valve second setting unit engagement means to a closed position;

e) a pivot unit having:
   i) means for moving said setting unit first stop means toward said open position responsive to actuation of a gas pedal;

f) said first stop adjuster being extended in normal operation to provide said first partially open position, and said second stop adjuster being retracted in normal operation to permit said degree of throttle opening means to operate said flap between said closed position and said partially open position; and g) said first and second stop adjuster being disabled during an emergency so that said first stop adjuster retracts and said second stop adjuster extends to provide a second partially open position.

2. Electronic throttle valve assembly as in claim 1 which includes:

a) means for linking said throttle valve second means for engagement with said setting unit to said setting unit first stop means during emergency operation so that said throttle valve may be operated mechanically by a gas pedal.

3. Electronic throttle valve assembly as in claim 2 wherein:

a) said throttle valve unit includes an actual value transducer for sensing the degree of opening of the throttle valve;

b) said pivot unit includes a desired value transducer for sensing the degree of opening in response to actuation of said gas pedal;

c) said degree of throttle opening means is a servomotor;

d) said first and second stop adjusters each comprise a servomotor and a hydraulic pressure unit; and which includes:

e) a microprocessor which receives signals from said transducers and selectively actuates at least one of said stop adjusters and said servomotor for controlling the degree of opening said throttle valve;

f) said microprocessor is programmed to control in normal operation the opening angle of the throttle flap smaller than the angle of the gas pedal sensed by said desired value transducer.

4. Electronic throttle valve assembly as in claim 3 wherein:

a) said throttle valve unit servo includes a spring member linking a drive tang of said servo to a lever arm of said throttle flap; and b) said spring member linkage permits disconnection of said linking means for said emergency operation throttle valve second means from said setting unit first stop means to resume normal operation.

5. Electronic throttle valve assembly as in claim 4 wherein:

a) said linking means for said emergency operation throttle valve second means to said setting unit first stop means includes a disconnectable snap-link assembly.

6. Electronic throttle valve assembly as in claim 5 wherein:

a) said snap-link includes a spring that engages a protrusion on a tang born by a lever on said setting unit.

7. Electronic throttle valve assembly as in claim 4 wherein:

a) said second stop adjuster is spring biased to an extended position and said first stop adjuster is spring biased to a retracted position so that in an emergency loss of power or pressure said spring biases effect said extension and retraction of said respective stop adjusters.

8. Electronic throttle valve assembly as in claim 7 wherein:

a) in normal operation said first stop adjuster is set so that the stop contact point for said setting unit corresponds to a gasoline/air mixture throughput of about 60 kg/hr; and b) said second stop adjuster is completely retracted to not provide a contact stop point.

9. Electronic throttle valve assembly as in claim 8 wherein:

a) in emergency operation said first stop adjuster is retracted to not provide a contact stop point; and b) said second stop adjuster is extended to provide an actual value throttle valve opening angle of about $5° \pm 2°$.

10. Electronic throttle valve assembly as in claim 2 wherein:

a) said throttle valve unit includes an actual value transducer for sensing the degree of opening of the throttle valve;

b) said pivot unit includes a desired value transducer for sensing the degree of opening in response to actuation of said gas pedal;

c) said degree of throttle opening means is a servomotor;

d) said first and second stop adjusters each comprise a servomotor and a pneumatic pressure unit; and which includes:

e) a microprocessor which receives signals from said transducers and selectively actuates at least one of said stop adjusters and said servomotor for controlling the degree of opening said throttle valve;

f) said microprocessor is programmed to control in normal operation the opening angle of the throttle flap smaller than the angle of the gas pedal sensed by said desired value transducer.

11. Electronic throttle valve assembly as in claim 10 wherein:

a) said throttle valve unit servo includes a spring member linking a drive tang of said servo to a lever arm of said throttle flap; and b) said spring member linkage permits disconnection of said linking means for said emergency operation throttle valve second means from said setting unit first stop means to resume normal operation.

12. Electronic throttle valve assembly as in claim 11 wherein:

a) said linking means for said emergency operation throttle valve second means to said setting unit first stop means includes a disconnectable snap-link assembly.

13. Electronic throttle valve assembly as in claim 12 wherein:

a) said snap-link includes a spring that engages a protrusion on a tang born by a lever on said setting unit.

14. Electronic throttle valve assembly as in claim 11 wherein:

a) said second stop adjuster is spring biased to an extended position and said first stop adjuster is spring biased to a retracted position so that in an emergency loss of power or pressure said spring biases effects extension and retraction of said respective stop adjusters.

15. Electronic throttle valve assembly as in claim 14 wherein:

a) in normal operation said first stop adjuster is set so that the stop contact point for said setting unit corresponds to a gasoline/air mixture throughput of about 60 kg/hr; and b) said second stop adjuster is completely retracted to not provide a contact stop point.

16. Electronic throttle valve assembly as in claim 15 wherein:

a) in emergency operation said first stop adjuster is retracted to not provide a contact stop point; and b) said second stop adjuster is extended to provide an actual valve throttle valve opening angle of about $5° \pm 2°$.

* * * * *